US009968200B2

(12) United States Patent
Webb

(10) Patent No.: US 9,968,200 B2
(45) Date of Patent: May 15, 2018

(54) PORTABLE SEATING APPARATUS AND METHOD

(71) Applicant: IncuThink, LLC, Lehi, UT (US)

(72) Inventor: Jon Webb, Eagle Mountain, UT (US)

( * ) Notice: Subject to any disclaimer, the term of this patent is extended or adjusted under 35 U.S.C. 154(b) by 0 days. days.

(21) Appl. No.: 15/078,903

(22) Filed: Mar. 23, 2016

(65) Prior Publication Data

US 2016/0278531 A1 Sep. 29, 2016

Related U.S. Application Data

(60) Provisional application No. 62/136,951, filed on Mar. 23, 2015.

(51) Int. Cl.
*A47C 9/10* (2006.01)

(52) U.S. Cl.
CPC ..... *A47C 9/10* (2013.01)

(58) Field of Classification Search
CPC ..... A47C 9/10
See application file for complete search history.

(56) References Cited

U.S. PATENT DOCUMENTS 406,328 A * 7/1889 Yagn ..... A63B 25/10 297/4
690,122 A * 12/1901 Slagle ..... A45B 5/00 248/155
2,099,345 A * 11/1937 Olszanowski ..... A47C 9/10 297/4
2,877,828 A * 3/1959 Barnette, Jr. ..... A01K 97/10 108/28
3,467,033 A * 9/1969 Sienkiewicz ..... A47C 9/10 108/115
4,098,478 A 7/1978 Spitzke
4,232,896 A 11/1980 Caldwell
4,433,870 A * 2/1984 Bairen ..... A47C 9/10 248/188.5
4,451,080 A * 5/1984 Nix ..... A61H 3/00 135/84
4,676,547 A 6/1987 Spillman
5,149,174 A * 9/1992 Charash ..... A47C 9/025 248/125.1
5,662,488 A 9/1997 Alden
5,927,797 A * 7/1999 Ferguson ..... A47C 7/022 297/4

(Continued)

*Primary Examiner* — Philip Gabler
(74) *Attorney, Agent, or Firm* — Steven Rinehart

(57) ABSTRACT

The portable seat apparatus includes a telescopic support member and a seat receptacle. The telescopic support member includes a plurality of concentric sections that are extendable and retractable within each other. The concentric sections include a distal section and a proximal section. Adjacent concentric sections are coupled together via interlocking features. A bottom surface of the seat receptacle is coupled to the telescopic support member and a top surface of the seat receptacle is configured to operably engage a user in a seated position. The apparatus is configurable in a sit-mode and a storage-mode. In the sit-mode, the concentric sections are at least partially extended and the telescopic support member is perpendicular to the seat receptacle. In the storage-mode, the concentric sections of the telescopic member are retracted within each other and the seat receptacle is parallel to the telescopic support member.

14 Claims, 8 Drawing Sheets

(56) References Cited

U.S. PATENT DOCUMENTS

| | | | | |
|---|---|---|---|---|
| 6,062,638 | A | 5/2000 | Ferguson | |
| 6,138,973 | A * | 10/2000 | Woodward | B63B 29/06 248/188.5 |
| 6,192,908 | B1 | 2/2001 | Smith | |
| 6,226,068 | B1 | 5/2001 | Arcykiewicz et al. | |
| 6,893,097 | B1 | 5/2005 | Ebensperger et al. | |
| 6,997,511 | B2 * | 2/2006 | Marchand | A47C 9/025 297/313 |
| 7,172,219 | B2 | 2/2007 | Spragg et al. | |
| 7,396,083 | B2 | 7/2008 | Kasner | |
| 7,594,696 | B2 * | 9/2009 | Girard | B62J 1/08 297/130 |
| 7,740,308 | B2 | 6/2010 | Mishly | |
| 8,403,408 | B2 | 3/2013 | Hosler | |
| 2005/0242630 | A1 | 11/2005 | Miller | |

* cited by examiner

PORTABLE SEATING APPARATUS AND METHOD

CROSS-REFERENCES TO RELATED APPLICATIONS

This application claims the benefit of U.S. Provisional Patent Application No. 62/136,951 entitled "PORTABLE SEAT APPARATUS" and filed on Mar. 23, 2015 for Jon Webb, which is incorporated herein by reference.

FIELD

This disclosure relates generally to seating devices, and more particularly to portable seating devices.

BACKGROUND

There are many different types of portable seating devices. For example, lawn chairs fold flat to allow a person to more easily pack and store the lawn chair and collapsing camping chairs can be bundled to improve their portability. However, most conventional portable seating devices are still bulky, cumbersome, difficult to carry, difficult to store, and may be difficult to use.

SUMMARY

The subject matter of the present application has been developed in response to the present state of the art, and in particular, in response to the shortcomings of conventional seating devices. Accordingly, the subject matter of the present application has been developed to provide a portable seating apparatus and method that overcomes at least some of the above-discussed shortcomings of prior art devices.

Disclosed herein is one embodiment of a portable seat apparatus. The portable seat apparatus includes a telescopic support member and a seat receptacle. The telescopic support member includes a plurality of concentric sections that are extendable and retractable within each other. The plurality of concentric sections includes a distal section and a proximal section, which has an outer surface. Adjacent concentric sections are coupled together via interlocking features. The seat receptacle includes a bottom surface and a top surface. The bottom surface of the seat receptacle is coupled to the telescopic support member and the top surface of the seat receptacle is configured to operably engage a user in a seated position. The apparatus is configurable in a sit-mode and a storage-mode. In the sit-mode, the concentric sections are at least partially extended and respective longitudinal axis' of the telescopic support member and the seat receptacle are perpendicular to each other. In the storage-mode, the plurality of concentric sections of the telescopic member are retracted within each other and the outer surface of the proximal section is disposed adjacent the bottom surface of the seat receptacle so that the respective longitudinal axis' of the telescopic support member and the seat receptacle are parallel to each other.

According to one implementation, the bottom surface of the seat receptacle is both slidably and pivotally coupled to the proximal section of the plurality of concentric sections of the telescopic support member. In another implementation, when the apparatus is in the sit-mode, the proximal section of the plurality of concentric sections of the telescopic support member is coupled to the seat receptacle at a longitudinal midpoint of the seat receptacle. In such an implementation, when the apparatus is in the storage-mode, the proximal section of the plurality of concentric sections is coupled to the seat receptacle adjacent a lateral end panel of the seat receptacle. Changing between the sit-mode and the storage-mode includes sliding and pivoting of the telescopic support member relative to the seat receptacle.

In one implementation, the proximal section of the plurality of concentric sections of the telescopic support member has two elongate nubs extending from opposite sides of the outer surface and two respective circular nubs extending from the elongate nubs. In such an implementation, the bottom surface of the seat receptacle has two tapering channels that taper from a wide portion to a narrow portion and two respective uniform channels formed in the tapering channels. The elongate nubs are slidably engaged in the respective tapering channels and the circular nubs are slidably engaged in the respective uniform channels. When the elongate nubs are disposed in the wide portion of the respective tapering channels, the telescoping support member is pivotable relative to the seat receptacle. When the elongate nubs are disposed in the narrow portion of the respective tapering channels, the telescoping support member is prevented from pivoting relative to the seat receptacle.

In one implementation, the interlocking features include one or more protrusions engageable within grooves, wherein each groove has a longitudinal-sliding portion and a bent-retaining portion. The protrusions may be disposed on inner surfaces of one or more of the concentric sections and the grooves may be disposed on outer surfaces of one or more of the concentric sections. In one implementation, relative rotation between adjacent concentric sections of the plurality of concentric sections switches between a slide orientation and a locked orientation. The slide orientation is when the one or more protrusions are engaged within the longitudinal-sliding portion of the grooves and the locked orientation is when the one or more protrusions are engaged within the bent-retaining portion of the grooves.

In one implementation, the telescopic support member includes a visible locking indicator that indicates whether the concentric sections are in the slide orientation or the locked orientation. In one implementation, the concentric sections extend in a first direction and retract in a second direction opposite the first direction. The interlocking features, according to one implementation, limit extension of the plurality of concentric sections to the first direction and thus prevent extension of the plurality of concentric sections in the second direction.

In one implementation, the seat receptacle has lateral end panels that engage lateral edges of the concentric sections in the storage-mode. In another implementation, the seat receptacle and the telescopic support member are cylindrical and have a circular cross-sectional shape. In yet another implementation, the seat receptacle is a unitary component. In one implementation, the total height of the telescopic support member is adjustable via the interlocking features.

According to one implementation, at least one of the plurality of concentric sections has interlocking features substantially along its entire length to provide adjustability to a height of the telescopic support member. The distal section of the plurality of concentric sections of the telescopic support member may include a swappable distal tip for engaging different types of terrain.

Also disclosed herein is another embodiment of a portable seat apparatus. The portable seat apparatus includes a telescopic support member having a plurality of concentric sections that are extendable and retractable within each other. The plurality of concentric sections includes a distal section and a proximal section, wherein the proximal section has an outer surface. Adjacent concentric sections are coupled together via interlocking features. The portable seat apparatus also includes a seat receptacle having a bottom surface and a top surface. The bottom surface of the seat receptacle is slidably and pivotally coupled to the proximal section of the plurality of concentric sections of the telescopic support member and the top surface of the seat receptacle is configured to operably engage a user in a seated position.

The apparatus is configurable in a sit-mode and a storage-mode. In the sit-mode, the plurality of concentric sections are at least partially extended, respective longitudinal axis' of the telescopic support member and the seat receptacle are perpendicular to each other, and the proximal section of the plurality of concentric sections of the telescopic support member is coupled to the seat receptacle at a longitudinal midpoint of the seat receptacle. In the storage-mode, the plurality of concentric sections of the telescopic member are retracted within each other, the outer surface of the proximal section is disposed adjacent the bottom surface of the seat receptacle so that the respective longitudinal axis' of the telescopic support member and the seat receptacle are parallel to each other, and the proximal section of the plurality of concentric sections is coupled to the seat receptacle adjacent a lateral end panel of the seat receptacle. Changing between the sit-mode and the storage-mode includes sliding and pivoting of the telescopic support member relative to the seat receptacle.

Also disclosed herein is one embodiment of a method for portable seating. The method includes at least partially extending a plurality of concentric sections of a telescopic support member that are coupled together via interlocking features such that the telescopic support member has a desired height. The method further includes rotating the plurality of concentric sections relative to each other in a first circumferential direction about a longitudinal axis of the telescopic support member to longitudinally lock the plurality of concentric sections to secure the desired height of the telescopic support member. The method also includes securing a seat receptacle to a proximal section of the plurality of concentric sections of the telescopic support member such that a longitudinal axis of the seat receptacle is substantially perpendicular to the longitudinal axis of the telescopic support member.

In one implementation, the method includes rotating the plurality of concentric sections relative to each other in a second circumferential direction opposite the first circumferential direction about the longitudinal axis of the telescopic support member. In such an implementation, the method also includes retracting the plurality of concentric sections of the telescopic support member within each other such that the telescopic support member is in a collapsed state and at least partially housing the telescopic support member in the collapsed state within the seat receptacle such that an outer surface of the telescopic support member in the collapsed state is adjacent a bottom surface of the seat receptacle and such that the longitudinal axis of the seat receptacle is parallel to the longitudinal axis of the telescopic support member.

In one implementation, the method further includes sliding and pivoting the telescopic support member relative to the seat receptacle. In another implementation, the interlocking include comprise one or more protrusions engageable within grooves and each groove has a longitudinal-sliding portion and a bent-retaining portion. In such an implementation, at least partially extending the plurality of concentric sections of the telescopic support member includes sliding the one or more protrusions through the longitudinal sliding portion of the grooves and rotating the plurality of concentric sections relative to each other includes sliding the one or more protrusions into the bent-retaining portion of the grooves.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter of the present disclosure may be more readily understood, a more particular description of the subject matter will be rendered by reference to specific embodiments that are illustrated in the appended drawings. Understanding that these drawings depict only typical embodiments of the subject matter of the present disclosure and are not therefore to be considered to be limiting of its scope, the subject matter will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

Figure 1:
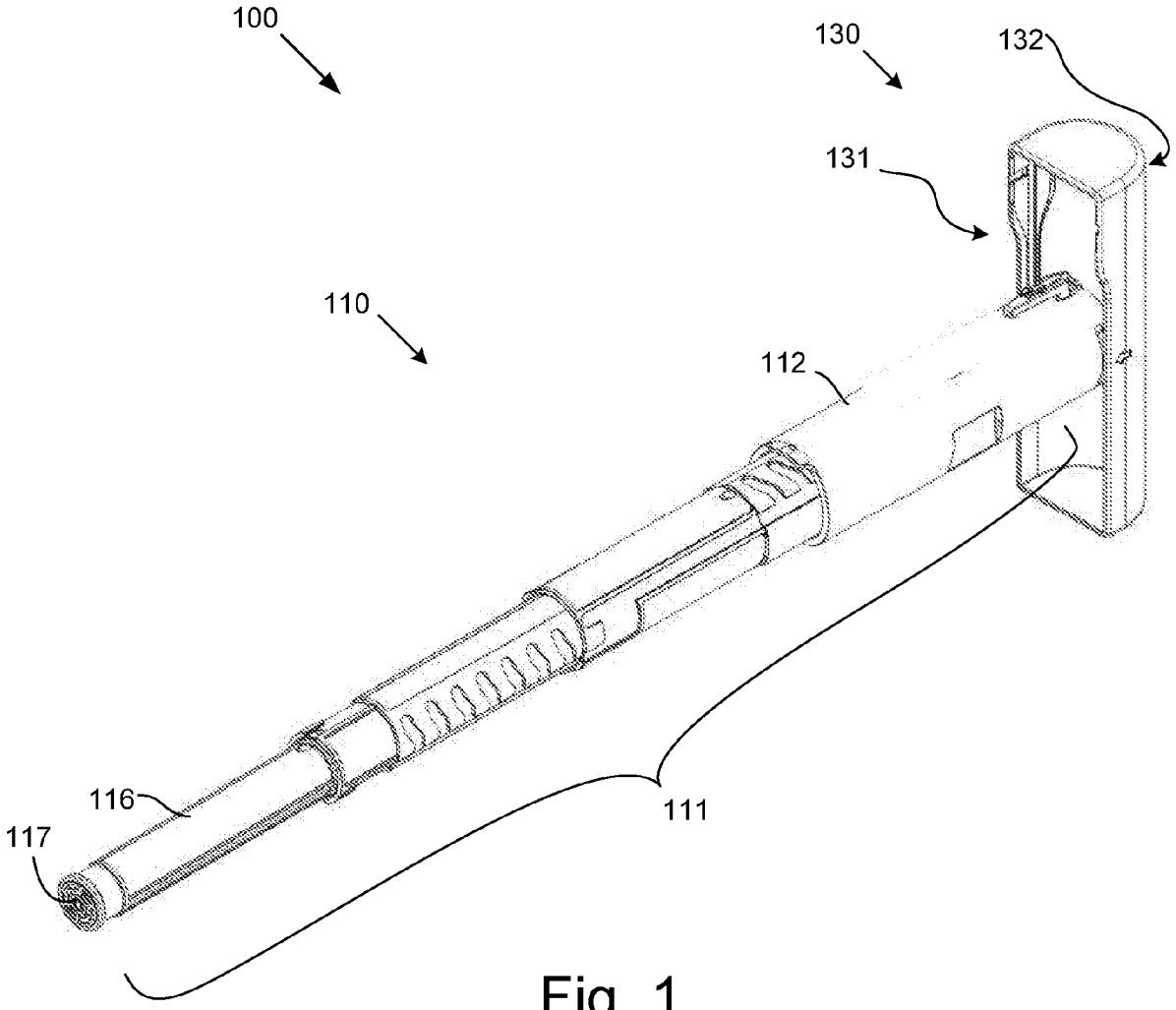
FIG. 1 is a perspective view a portable seat apparatus, in a sit-mode, that includes a telescopic support member and a seat receptacle, according to one embodiment.

FIG. 1 is a perspective view a portable seat apparatus 100 that includes a telescopic support member 110 and a seat receptacle 130, according to one embodiment. The portable seat apparatus 100 is a device that users can easily carry and transport to various locations and which can be configured to support at least a portion of a user's body weight. In other words, the portable seat apparatus 100 can be employed in a storage-mode (e.g., FIG. 2) or a sit-mode (e.g., FIG. 1). In the storage-mode, the portable seat apparatus 100 is collapsible to a compact form, thereby easily allowing users to carry the portable seat apparatus 100 to various locations, events, venues, activities, etc. For example, the portable seat apparatus 100 may be carried or transported in the storage-mode by a person watching a sporting event, going to a concert, hiking, golfing, watching a parade, visiting a theme park, fishing, waiting in lines, etc. When the user desires or needs to rest his legs or back or wishes to otherwise alleviate the body weight pressure that accompanies standing for periods of time, the user may reconfigure the portable seat apparatus 100 to be in the sit-mode and to thus support at least a portion of the user's body weight.

Included in the following pages are details relating to the portable seat apparatus 100 with reference to various depicted embodiments. More specifically, the present disclosure includes details relating to the structural configuration of the components that constitute the portable seat apparatus 100 and how such structural configurations allow the portable seat apparatus 100 to be swappable between the storage-mode in the sit-mode.

As stated above, the portable seat apparatus 100 includes a telescopic support member 110 and a seat receptacle 130. The telescopic support member 110 includes a plurality of concentric sections 111. These concentric sections 111 are extendable and retractable. When extended, the plurality of concentric sections 111 form an elongate shaft that is substantially perpendicular to the seat receptacle 130 in the sit-mode (depicted in FIG. 1). In the storage-mode, as described below in greater detail with reference the remaining figures, the concentric sections 111 of the telescopic support member 110 telescopically retract within each other, thus collapsing the telescopic support member 110 into a compact form for storage/transport (i.e., the collapsed telescopic support member 110 and the seat receptacle 130 are parallel to each other).

The concentric section that is coupled to the seat receptacle 130 when the portable seat apparatus 100 is in the sit-mode (as depicted in FIG. 1) is referred to herein as the proximal section 112 and the concentric section that is disposed on the opposite end of the telescopic support member 110 is referred to herein as the distal section 116. As described in greater detail below, the proximal section 112 is coupled to a bottom surface 131 of the seat receptacle 130 in the sit-mode and a user of the portable seat apparatus 100 can sit on (or at least rest one or more body parts on) a top surface 132 of the seat receptacle 130. In one embodiment, a tip 117 for engaging a ground surface is coupled to or integrated with the distal section 116 of the plurality of concentric sections 111 of the telescopic support member 110. In one embodiment, the tip 117 may be detachably coupled to the telescopic support member 10 and/or the tip 117 may be swappable. In one embodiment, for example, the apparatus may include a rubber tip 117 that facilitates and secure engagement with flat, hard terrain such as cement, asphalt, laminate, wood, stone, tile, etc. In another embodiment, the apparatus may include a spike tip or the tip may have some other features that promote a secure engagement with dirt, mud, grass, etc.

Figure 2:
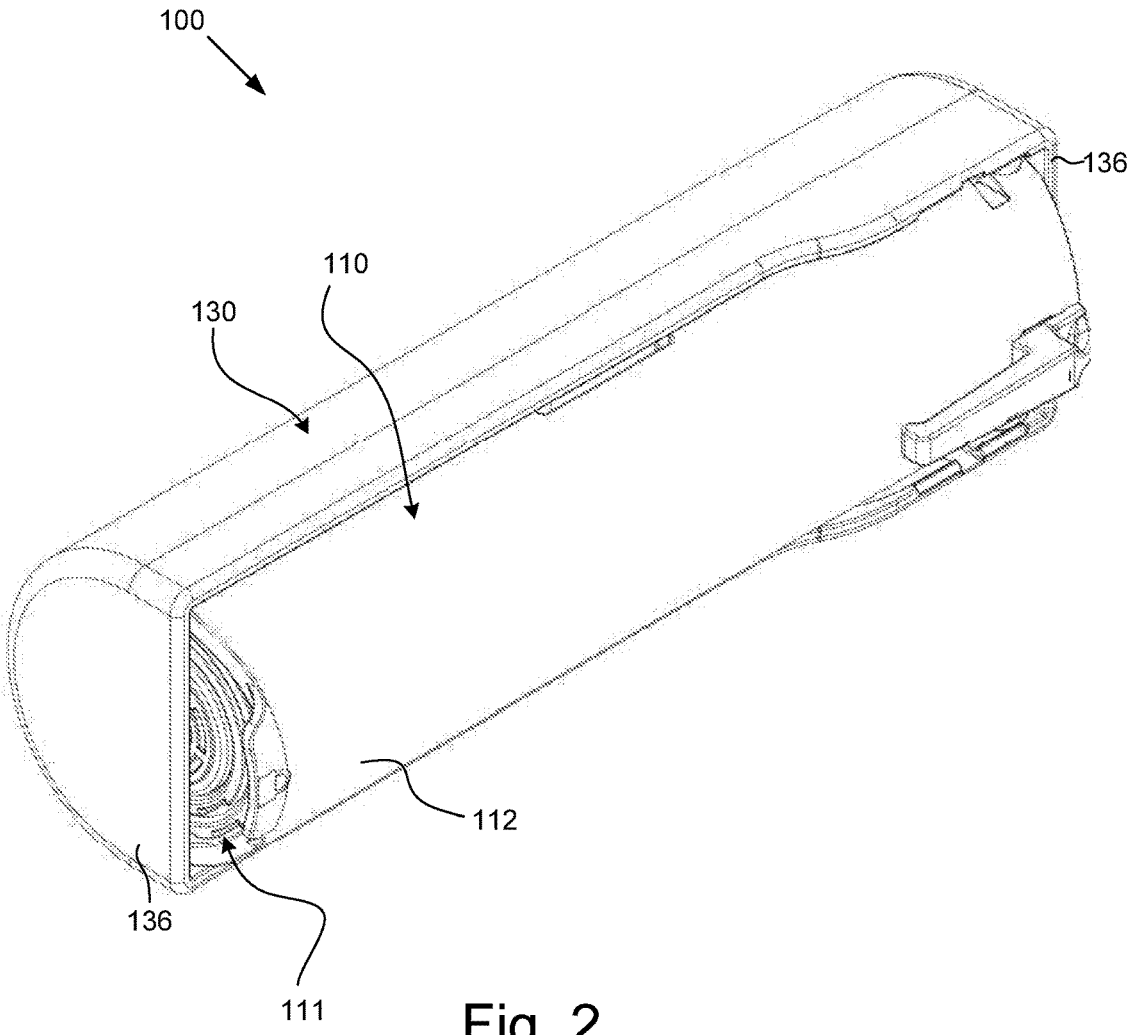
FIG. 2 is a perspective view of the portable seat apparatus in a storage-mode, according to one embodiment.

FIG. 2 is a perspective view of the portable seat apparatus 100 in a storage-mode, according to one embodiment. As described above, the portable seat apparatus 100 is in the storage-mode when the plurality of concentric sections 111 of the telescopic support member 110 are telescopically collapsed within each other and the collapsed telescopic support member is at least partially housed within (e.g., partially received within) the confines of the seat receptacle 130. In one embodiment, as shown in FIG. 2, the bottom surface 131 of the seat receptacle 130 is cylindrically concave and the cylindrical telescopic support member can be received therein. In one embodiment, the seat receptacle 130 includes one or more lateral end panels 136 that partially surround the collapsed telescopic support member 110. The lateral end panels 136 may help to prevent the collapsed concentric sections 111 from inadvertently expanding while in the storage-mode by engaging the lateral edges 118 of the concentric sections 111. In one embodiment, the lateral end panels 136 may facilitate the coupling between the telescopic support member 110 and the seat receptacle 130. For example, in one embodiment one or both of the lateral end panels 136 may include a lip or a partial lip that facilitates holding the collapsed telescopic support member 110 at least partially within the confines of the seat receptacle 130. Thus, the collapsed telescopic support member 110 may be secured/coupled to the seat receptacle 130 via a resistive fit between one or more lateral edges of the concentric sections 111 and the lip or lateral end panels.

In another embodiment, however, the apparatus may not include end panels and/or the apparatus may have other means for preventing the concentric sections 111 from inadvertently extending or from extending. Additional details regarding extension and retraction of the concentric sections are included below with reference to FIG. 4. Also, further details relating to the means of coupling the telescopic support member 110 and the seat receptacle 130 are included below with reference to FIGS. 5 and 7A-7C.

Figure 3:
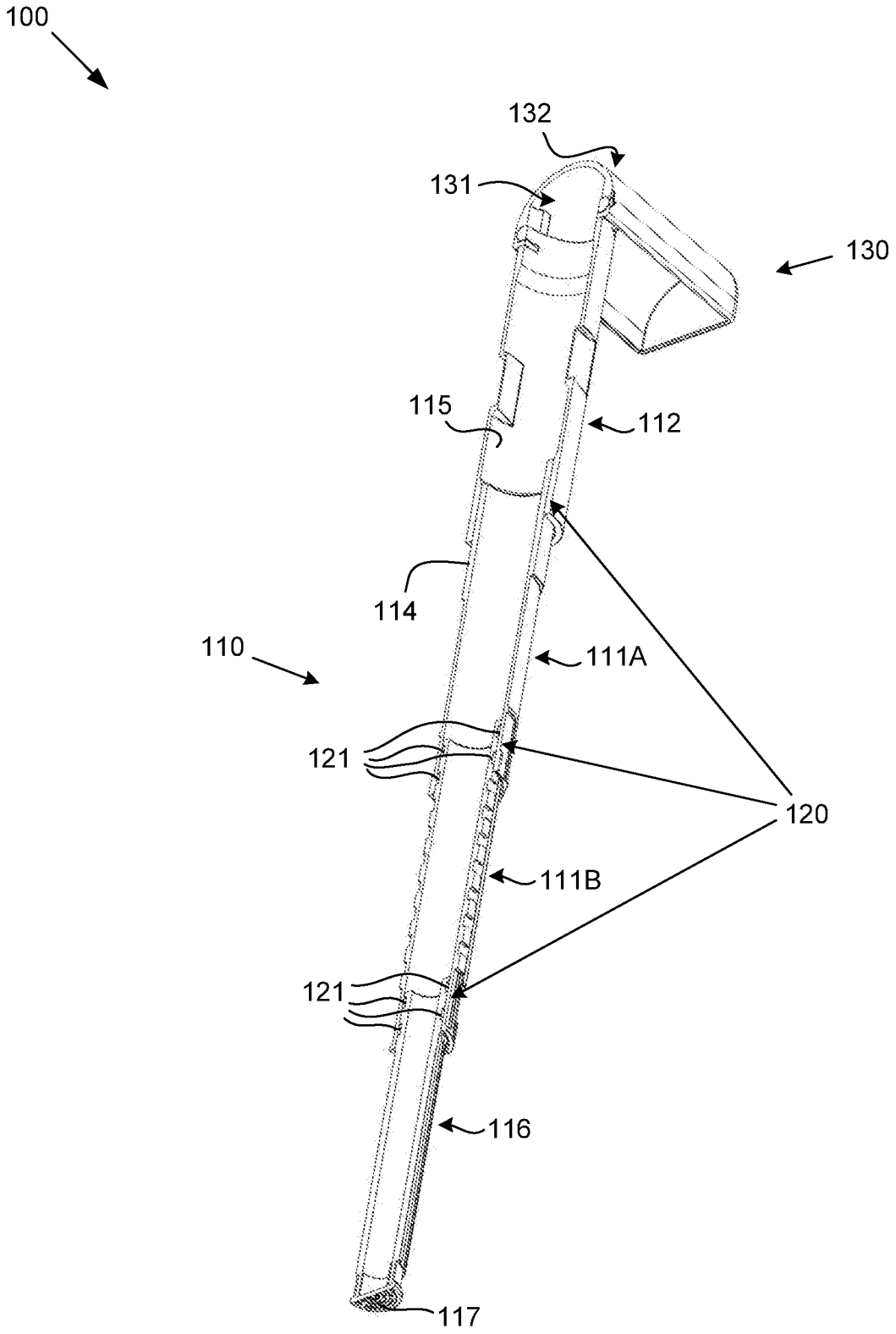
FIG. 3 is a cross-section view of the portable seat apparatus in the sit-mode, according to one embodiment.

FIG. 3 is a cross-section view of the portable seat apparatus 100 in the sit-mode, according to one embodiment. Throughout the present disclosure, the term "plurality of concentric sections" and the reference number "111" refers collectively to the telescopic concentric sections the form the telescopic support member 110. In FIG. 3, however, individual concentric sections are individually labeled. In other words, the top section is the proximal section 112, the bottom section is the distal section 116, and the middle sections are the intermediate concentric sections 111A, 111B. When the portable seat apparatus 100 is in the sit-mode, the plurality of concentric sections 111 (112, 111A, 111B, 116) are shown in an extended configuration with interlocking features 120 disposed between adjacent concentric sections 111. As described in greater detail below, the interlocking features 120 generally allow for the user to securely lock the extended concentric sections 111 of the telescopic support member 110 in the sit-mode to prevent the plurality of concentric sections 111 from retracting/collapsing when a user sits or rests a body part upon the seat receptacle 130. However, the interlocking features 120 are also unlockable in order to allow user to quickly and easily collapse the telescopic support member 110. Thus, according to one embodiment, the interlocking features 120 are robust and secure enough to support the weight of a user while at the same time being simply and quickly disengageable in order to collapse the concentric sections 111. The height of the seat apparatus 100 (i.e., the height or length of the telescoping support member) may be adjusted via the interlocking features 120.

In one embodiment, the interlocking features 120 include first interlocking features disposed on a respective inner surface 115 of one of the concentric sections (e.g., inner surface 115 of proximal section 112) and corresponding second interlocking features disposed on a respective outer surface 114 of an adjacent concentric section (e.g., outer surface 114 of intermediate concentric section 111A).

The concentric sections 111, although shown throughout the figures of the present disclosure as cylindrical, may have other cross-sectional shapes. For example, the plurality of concentric sections 111 may have a cross-sectional shape that is rectangular, triangular, polygonal, or other shape. The number of concentric sections 111 that form the telescopic support member 110 may be application dependent. For example, depending on the size/height of the user, more or less concentric sections may be employed depending on the desired sitting/supporting height of the seat receptacle 130 in the sit-mode. In one embodiment, the number of concentric sections may be between two and ten. In another embodiment, the number of concentric sections may be between three and 6. In yet another embodiment, the telescopic support member 110 may have four concentric sections. In one embodiment, the length of each section may be between about 3 inches and about 10 inches. In another embodiment, the length of each section may be between about 5 inches and about 8 inches. In one embodiment, the total length/height of the portable seat apparatus 100 may be between about 40 inches and about 15 inches. In another embodiment, the total length/height of the portable seat apparatus 100 may be between about 30 inches and about 20 inches. As described below, the total length/height of the portable seat apparatus 100 may be adjustable so that a user can easily select his preferred sitting height.

In one implementation, the concentric sections 111 of the telescopic support member 110, while still being extendable and retractable, may be permanently coupled together. In other words, in one embodiment the telescopic support member 110 may not be disassembled into individual concentric sections. However, in another embodiment, the plurality of concentric sections 111 of the telescopic support member 110 may be decoupled from one another, thus allowing a user to add additional sections and/or swap existing sections. Further details relating to the interlocking features 120 and the coupling between the concentric sections 111 are included below with reference to FIGS. 4 and 5.

The size/dimensions of each of the concentric sections 111 may also be application dependent. For example, one implementation of the portable seat apparatus 100 may be specifically designed for children or smaller users and correspondingly the dimensions (e.g., length, material thickness, section width, etc) of the concentric sections 111 may be smaller. In another embodiment, the dimensions of the concentric sections 111 may be comparatively larger (e.g., longer, thicker, wider) for an implementation of the portable seat apparatus that is designed to be used by an adult. In one embodiment, the plurality of concentric sections 111 may be constructed from metal, plastic, wood, composite, etc. In another embodiment, each section of the plurality of concentric sections 111 may be tapered. In another embodiment, the proximal section 112 may be the smallest section and the distal section 116 may be the largest section (opposite the configuration shown in the figures). In other words, in one embodiment, the narrowest telescopic section of the telescopic support member 110 may be coupled to the bottom surface 131 of the seat receptacle 131 while the widest telescopic section of the telescopic support member 110 may be engageable on the ground surface.

As briefly mentioned previously, the proximal section 112 is the concentric section that is coupled with the seat receptacle 130 in the sit-mode and the distal section 116 is the concentric section that is engageable on the ground surface (the distal section 116 may optionally include a tip 117). The tip 117 may be permanently coupled to the distal section 116. In another embodiment, however, the tip 117 may be detachably coupled to the distal section 116, thus allowing a user to swap tips based on an expected use or an expected condition of the ground surface against which the tip will be engaged. For example, in one embodiment the tip 117 may be constructed from a rubber-like material that increases the friction of the engagement between the apparatus 100 and the ground surface, thus preventing or at least mitigating inadvertent slipping between the distal section 116 and the ground surface.

The proximal section 112 may be coupled to the bottom surface 131 of the seat receptacle 130 via various coupling mechanisms. In one embodiment, the bottom surface 131 of the seat receptacle 130 may include protruding tabs to which the proximal section 112 is engaged. For example, a proximal edge of the proximal section 112 may include one or more notches that engage the tabs that are disposed on the bottom surface 131 of the seat receptacle 130. In one embodiment, the seat receptacle is detachable from the telescopic support member. In another embodiment, the seat receptacle is pivotally and/or slidably coupled to the telescopic support member. Additional details and descriptions relating to the coupling between the seat receptacle and the telescopic support member are included below with reference to FIGS. 7A-7C.

Figure 4:
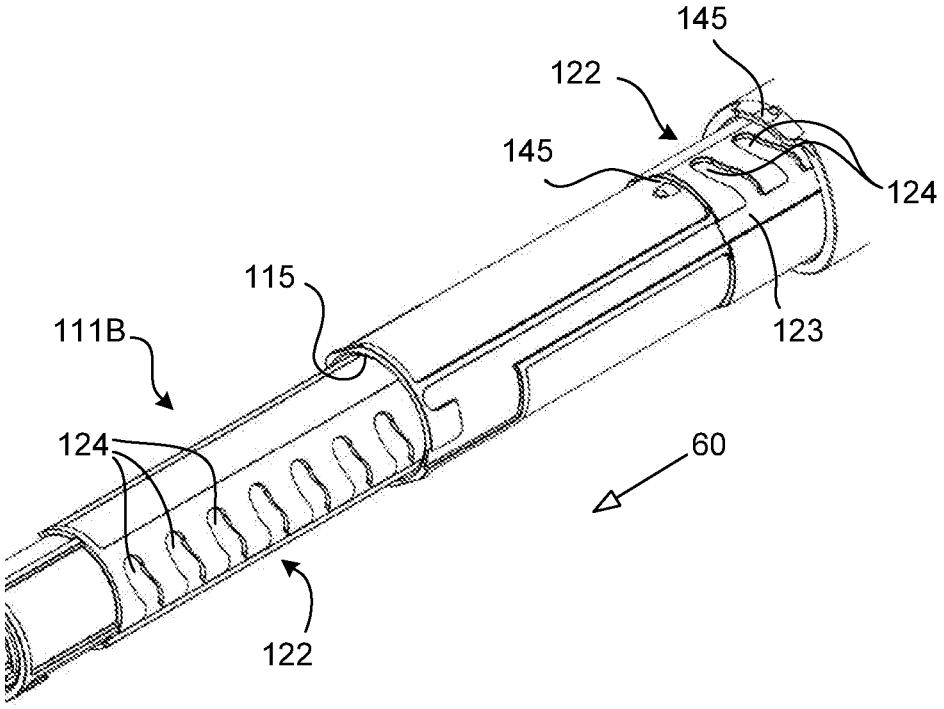
FIG. 4 is a perspective view of interlocking features on concentric sections, according to one embodiment.
Figure 5:
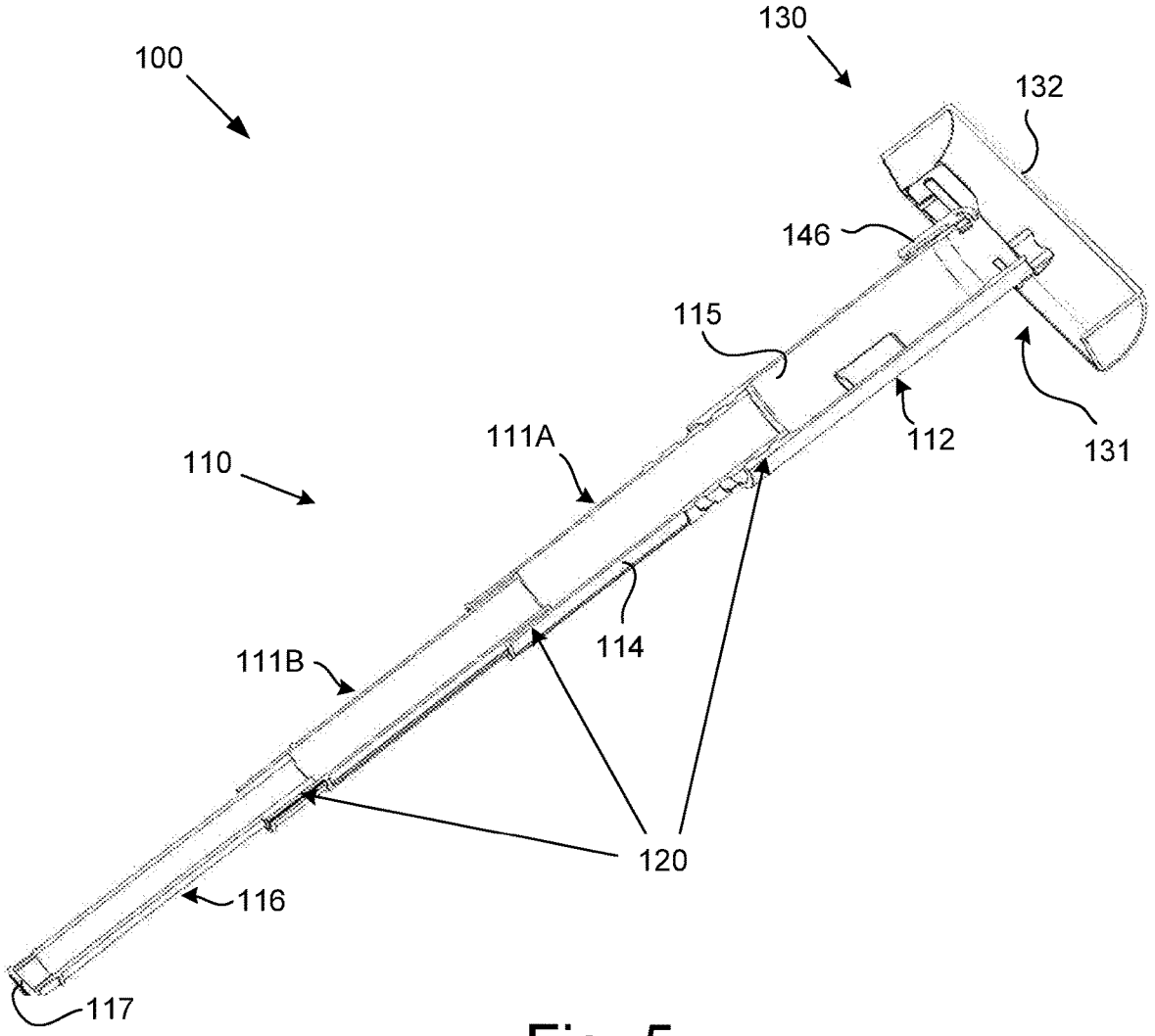
FIG. 5 is a cross-section view of the portable seat apparatus, according to one embodiment.

FIG. 4 is a perspective view of one embodiment of the interlocking features 120 on the concentric sections and FIG. 5 is a cross-section view of the portable seat apparatus 100. In one embodiment, the interlocking features 120 are grooves and corresponding protrusions 121 (FIG. 3). For example, a series or pattern of grooves 122 may be disposed (e.g., formed or etched) on the outer surface 114 of one or more of the concentric sections and one or more corresponding protrusions 121 (FIG. 3) can be received within the grooves 122. In one embodiment, each groove 122 may be a notch, trench, rut, score, channel, trough, or the like. The protrusions 121 may be bumps that are integrated/unitary with each concentric section or the protrusions 121 may be made from pins or bolts that are coupled/mounted to each of the concentric sections.

In one embodiment the interlocking features may include other mechanisms and/or other configurations. For example, a spring-loaded push button mechanism may be utilized to secure the concentric sections in place. In another embodiment, a tongue-and-groove design may be implemented as the interlocking features.

According to one embodiment, distal section 116 and the intermediate sections 111A, 111B (i.e., all the sections except for the proximal section 112) may have a series/pattern of grooves disposed on each section's outer surface 114. Correspondingly, the proximal section 112 and the intermediate sections 111A, 111B (i.e., all the sections except for the distal section 116) may have one or more protrusions 121 disposed on each sections inner surface 115. The protrusions 121 may be received within the grooves 122 to couple and/or lock the plurality of concentric sections in an extended position (i.e., the sit-mode). In one embodiment, each concentric section is coupled to an adjacent concentric section via two or more protrusions 121 and the respective grooves 122, thus improving the structural rigidity of the telescopic support member and decreasing the extent of wobble or play in the shaft.

In one embodiment, each of the grooves may include a longitudinal-sliding portion 123 and one or more bent-retaining portions 124. When the protrusions 121 are received within the longitudinal-sliding portion 123 of the grooves 122, the relative longitudinal position of the concentric sections can be adjusted, thus allowing the plurality of concentric sections to collapse and retract. In such an embodiment, when a user desires to lock the relative longitudinal position of the concentric sections, the user may apply a rotational force to one or more of the concentric sections, thereby causing the protrusions 121 to leave the longitudinal-sliding portion 123 of the grooves 122 and to be received within the bent-retaining portions 124 of the grooves 122. With the protrusions 121 received within the bent-retaining portions 124 of the grooves 122, relative longitudinal sliding between the concentric sections is prevented, thus allowing the telescopic support member 110 to be locked at a certain length in the sit-mode.

In one embodiment, each of the bent-retaining portions 124 of the grooves 122 may have a lobed configuration or a hooked configuration that not only prevents longitudinal sliding but also restricts, at least to a certain degree, relative rotational movement of the concentric sections. In other words, with the protrusions 121 received within the bent-retaining portions 124 of the grooves 122, the plurality of concentric sections are in a locked orientation and the downward force 60 from the body weight of a user that is sitting or resting a portion of the body on the portable seat apparatus 100 will not cause the plurality of concentric sections 111 to collapse. Further, the downward force 60 also prevents or at least inhibits the protrusions 121 from inadvertently moving upward in the bent-retaining portions 124 of the groove 122, which would cause the protrusions 121 to be susceptible to slipping sideways into the longitudinal-sliding portion 123 of the grooves 122 and thereby inadvertently collapsing the telescopic support member 110. In one embodiment, each of the bent-retaining portions 124 of the grooves 122 may have a single lobed structure. In another embodiment, each of the bent-retaining portions of the grooves may have a double lobed structure, facilitating a locking engagement between adjacent concentric sections regardless of whether the force along the length of the telescopic support member 110 is in the upward or downward direction. However, in the implementation in which the bent-retaining portions 124 of the grooves 122 have a double lobed structure, the ease and convenience of switching between the sit-mode and storage-mode may be diminished.

When the bent groove has a single-lobed (i.e., hooked) shape and when the telescopic support member 110 is in the extended/sit-mode position, the user would only need to grasp the distal section 116 and the proximal section 112 and exert an expanding/pulling force, thus causing the protrusions 121 to move slightly upward out of the lobed segment of each of the bent-retaining portions 124 of the grooves 122, followed by a slight rotational force, thus causing the protrusions 121 to move slightly sideways out of the bent-retaining portions 124 of the grooves 122 and into the longitudinal-sliding portion 123 of the grooves 122. As described above, with protrusions 121 in the longitudinal-sliding portion 123 of the grooves 122, the plurality of concentric sections 111 are in the slide orientation and the telescopic support member 110 is ready to be collapsed by slidably receiving adjacent concentric sections within each other.

As briefly mentioned above, in one embodiment the protrusions 121 are maintained within the longitudinal sliding portion 123 of the grooves 122 so as to prevent the concentric sections 111 from becoming uncoupled and/or to prevent the concentric sections 111 from extending the wrong direction.

In one embodiment, one or more of the concentric sections may have a groove pattern that extends along a substantial length of the respective concentric section. In such a configuration, the extended length of the telescopic support member 110 may be adjusted according to which bent-retaining portions 124 the protrusions 121 are engaged within. In other words, as depicted in FIG. 4, one of the intermediate concentric sections 111B may have a groove 122 the comprises a longitudinal-sliding portion 123 that extends along a majority of the length of the section 111B and that has multiple bent-retaining portions 124 along the length of the longitudinal-sliding portion 123, whereby user may select which of the bent-retaining protrusions 124 will receive the protrusions 121 thereby allowing the user to vary the total length of the telescopic support member 110. In one embodiment, two or more of the concentric sections may include such an extended groove configuration, thereby allowing further flexibility and adjustability to the total length of the telescopic support member 110. In another embodiment, one or more of the sections may not be extended (i.e., may remained retracted within another section), thus allowing the height of the seat apparatus to be further customized and adjusted.

In one embodiment, multiple sets of protrusions 121 and grooves 122 may be circumferentially distributed about a circumference of each concentric section and/or the protrusions 121 and the patterns/series of grooves 122 may be longitudinally spaced along at least a segment of each corresponding concentric section. The distribution and spacing of interlocking features 120 may improve the coupling/locking between adjacent concentric sections. For example, the corresponding concentric sections may each include a first set of two protrusions spaced longitudinally apart on a first region of each concentric section with the second set of church two protrusions spaced longitudinally apart on a second region that is on the opposite side of each of the concentric sections. In such an embodiment, the circumferential distribution of interlocking features 120 facilitates the coupling/locking between adjacent concentric sections and eliminates or at least mitigates loose or ill-fitting engagement between adjacent concentric sections, thus improving the safety and rigidity of the telescopic support member 110.

As described above, in one embodiment the plurality of concentric sections may be completely decoupled from each other and disassembled. In another embodiment, the plurality of concentric sections may not be disassembled. For example, as mentioned above, the longitudinal-sliding portion 123 of the grooves 122 may be capped on both ends, thus preventing the protrusions 121 from sliding entirely out of the grooves 122. In one embodiment, the proximal section has a proximal edge that has an arcuate/wave shape which conforms to and contours the bottom surface 131 of the seat receptacle 130 (e.g., the arcuate proximal edge may engage the inner surface of the semi-cylinder that is the seat receptacle).

Figure 6:
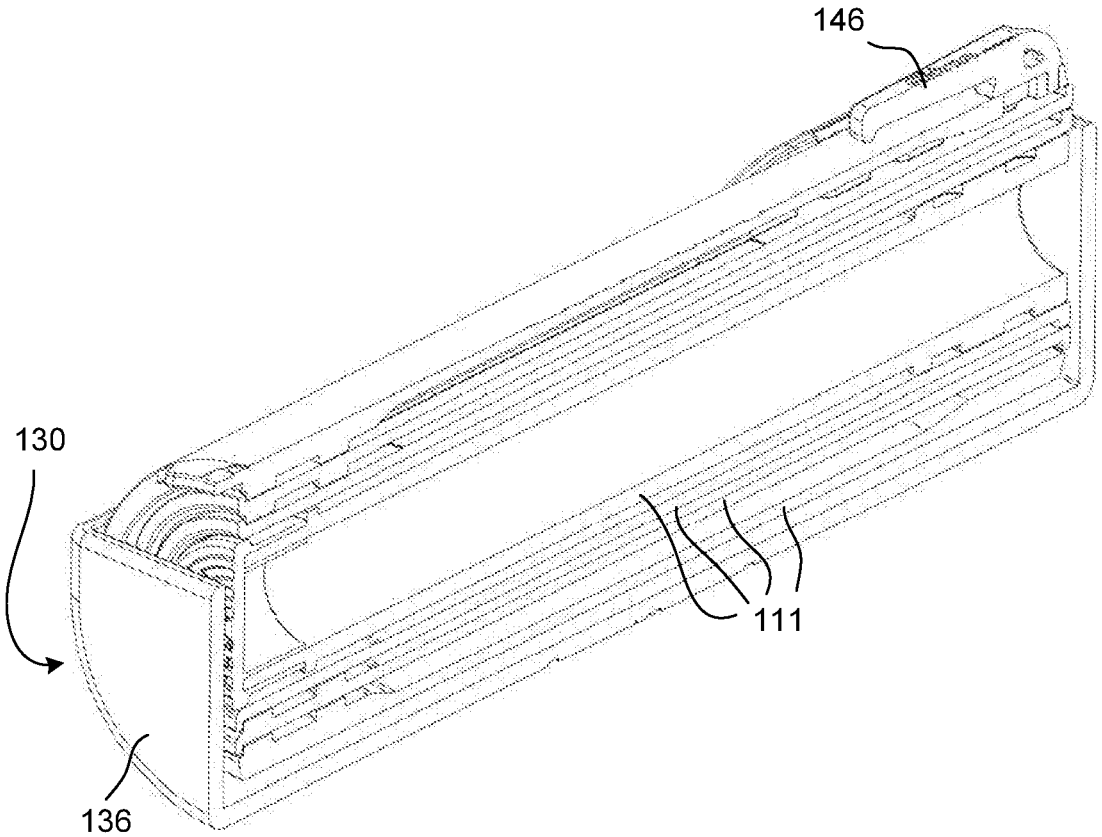
FIG. 6 is a cross-section view of the telescopic support member with the concentric sections retracted within each other, according to one embodiment.

FIG. 6 is a cross-section view of one embodiment of the telescopic support member 110 having the concentric sections 111 retracted within each other. In one embodiment, as mentioned above, the seat receptacle 130 may have a cylindrical shape that allows the cylindrical concentric sections to be collapsed and housed therein in the storage-mode. In one embodiment, the seat receptacle 130 is a solid, unitary structure. In other words, in one embodiment the seat receptacle 130 does not bend or fold along a hinge element but is a single piece of material that is capable of supporting the body weight of a user. Because the seat receptacle 130 is unitary and rigid, and thus does not bend, fold, or hinge, the structural integrity of the seat apparatus 100 is improved over conventional portable seating devices that may have horizontally extending seat structures that hinge, pivot, or otherwise collapse.

Figure 7A:
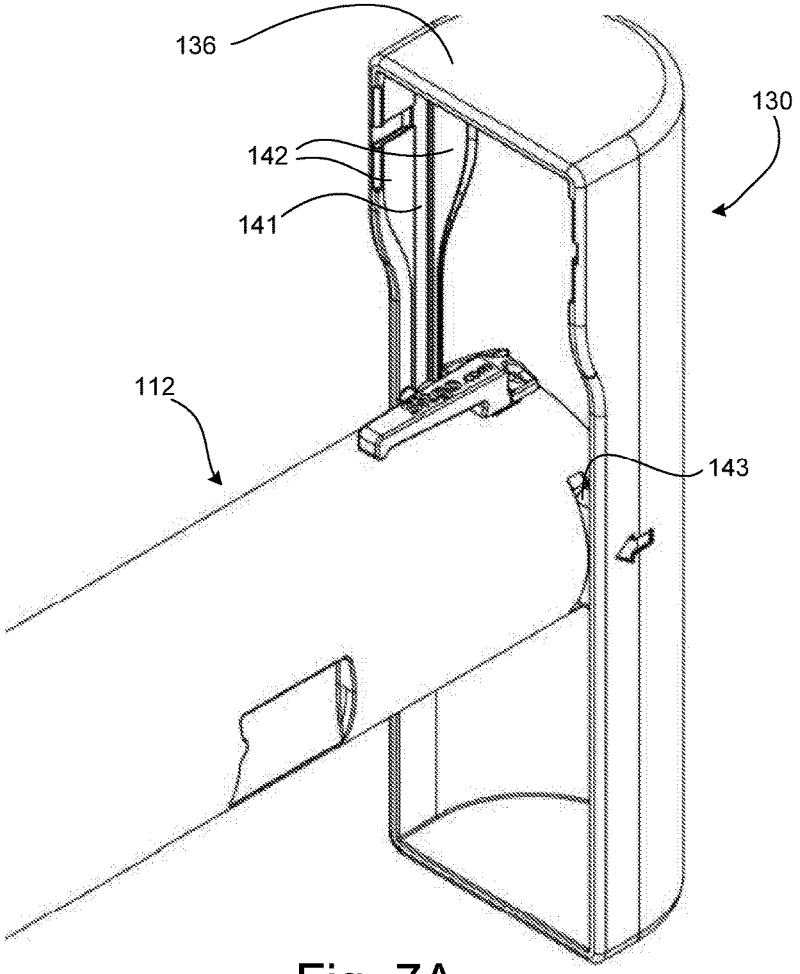
FIG. 7A is a perspective view of a bottom surface of the seat receptacle coupled to the telescopic support member, according to one embodiment.
Figure 7B:
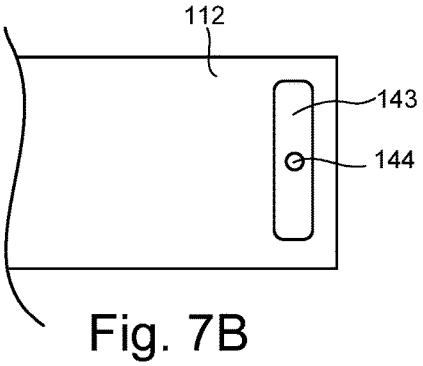
FIG. 7B is a partial schematic front view of the telescopic support member of FIG. 7A detached from the seat receptacle, according to one embodiment.
Figure 7C:
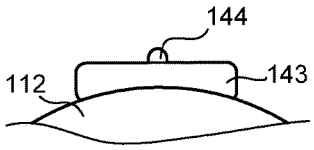
FIG. 7C is a partial schematic side view of the telescopic support member of FIG. 7A detached from the seat receptacle, according to one embodiment.

In one embodiment, as shown in FIGS. 7A-7C, the bottom surface of the seat receptacle 130 is both slidably and pivotally coupled to the proximal section 112 of the plurality of concentric sections 111 of the telescopic support member 110. In other words, in the sit-mode the proximal section 112 is coupled to the seat receptacle 130 at a longitudinal midpoint of the seat receptacle 130 and in the storage-mode the proximal section 112 is coupled to the seat receptacle adjacent a lateral end panel 136 of the seat receptacle 130. Transitioning from the sit-mode to the storage-mode, and vice-versa, involves sliding the proximal section 112 relative to the seat receptacle 130 and pivoting the proximal section 112 relative to the seat receptacle 130.

In one specific embodiment, the proximal section 112 of the plurality of concentric sections includes two elongate nubs 143 extending from opposite sides of the outer surface of the proximal section 112. Two respective circular nubs 144 extend from the elongate nubs 143, as shown in FIGS. 7B and 7C. Thus, the circular nubs 144 have a comparatively greater height, as measured from the outer surface of the proximal section 112, than the elongate nubs 143. The bottom surface of the seat receptacle 130 has tapering channels 142 and uniform channels 141. The tapering channels 142 have a wide portion and a narrow portion. The elongate nubs 143 are slidably engaged in the respective tapering channels 142 and the circular nubs 144 are slidably engaged in the respective uniform channels 141. When elongate nubs 143 are disposed in the wide portion of the respective tapering channels 142, the telescoping support member 110 is pivotable relative to the seat receptacle and when the elongate nubs 143 are disposed in the narrow portion of the respective tapering channels 142, the telescoping support member is prevented from pivoting relative to the seat receptacle 130.

The telescopic support member 110 may be coupled to the seat receptacle 130 via other or additional coupling mechanisms. For example, interlocking knobs, fasteners, pins, clips, ties, claps, buckles, or other similar mechanisms and configurations may be utilized to securely couple the telescopic support member 110 to the seat receptacle 130. In one embodiment, the seat receptacle 130 may have a circular ring extending from or integrated with the bottom surface 131. The proximal edge 113 of the proximal section may engage the circular ring (by either surrounding the circular ring or being inserted within the circular ring) to facilitate the coupled connection between the two components 110, 130.

The following example includes specific details and dimensions relating to one implementation of the portable seat apparatus.

EXAMPLE

The telescopic support 110 member includes four concentric sections. Each of the concentric sections is about 8 inches long. One of the concentric sections includes a groove structure 122 that extends along a majority of the length of the section, thus allowing the user to select which bent-retaining groove portions 124 will receive the corresponding protrusions 121. Accordingly, the length of the telescopic support member 110 is adjustable so that the total length/height of the portable seat apparatus can be incrementally varied between about 27 inches and about 22 inches.

Figure 8:
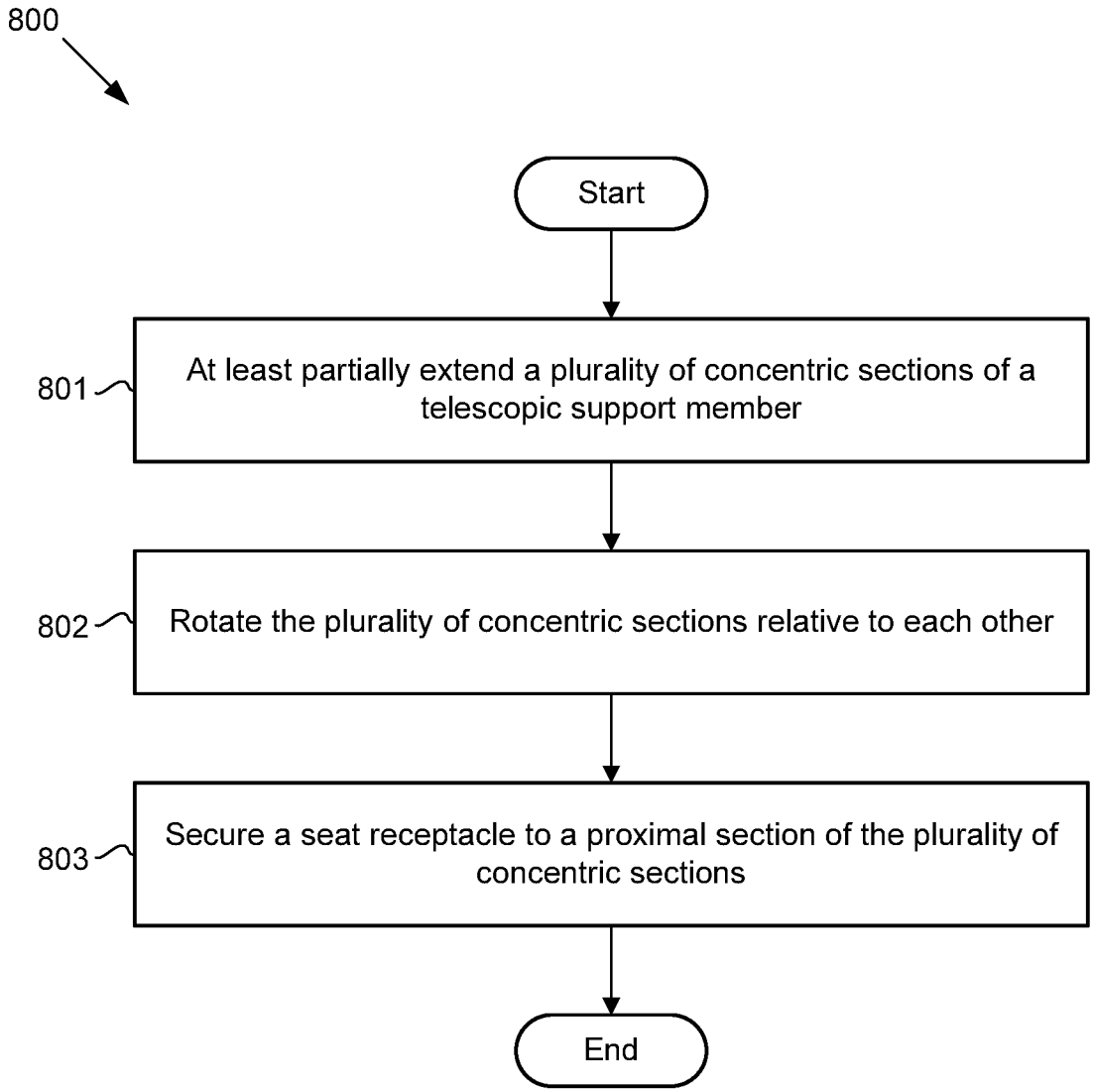
FIG. 8 is a schematic flow chart diagram of a method for portable seating, according to one embodiment.

FIG. 8 is a schematic flow chart diagram of one embodiment of a method 800 for portable seating. In other words, the method 800 in FIG. 8 includes steps for deploying the seat apparatus 100 in the sit-mode. The method 800 includes extending a plurality of concentric sections of a telescopic support member that are coupled together via interlocking features such that the telescopic support member has a desired height at 801. The method 800 further includes rotating the plurality of concentric sections relative to each other in a first circumferential direction about a longitudinal axis of the telescopic support member to longitudinally lock the plurality of concentric sections to secure the desired height of the telescopic support member at 802. Further, the method 800 includes securing a seat receptacle to a proximal section of the plurality of concentric sections of the telescopic support member such that a longitudinal axis of the seat receptacle is substantially perpendicular to the longitudinal axis of the telescopic support member at 803.

In one embodiment, the method 800 also includes rotating the plurality of concentric sections relative to each other in a second circumferential direction opposite the first circumferential direction about the longitudinal axis of the telescopic support member and retracting the plurality of concentric sections of the telescopic support member within each other such that the telescopic support member is in a collapsed state. The method 800 may also include at least partially housing the telescopic support member in the collapsed state within the seat receptacle such that an outer surface of the telescopic support member in the collapsed state is adjacent a bottom surface of the seat receptacle and such that the longitudinal axis of the seat receptacle is parallel to the longitudinal axis of the telescopic support member.

As mentioned above, in one embodiment the method 800 includes sliding and pivoting the telescopic support member relative to the seat receptacle. In another embodiment, the interlocking features include one or more protrusions engageable within grooves. Each groove formation includes a longitudinal-sliding portion and a bent-retaining portion. In such an implementation, extending the plurality of concentric sections includes sliding the one or more protrusions through the longitudinal sliding portion of the grooves. Correspondingly, rotating the plurality of concentric sections relative to each other includes sliding the one or more protrusions into the bent-retaining portion of the grooves.

In the above description, certain terms may be used such as "top," "bottom," "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, a "top" surface can become a "bottom" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Also, securing one element to another element can include direct and indirect securing. Additionally, as used herein, "adjacent" does not necessarily denote contact (i.e., one element can be adjacent to another without being in contact with the other).

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The subject matter of the present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. A portable seat apparatus comprising:

a telescopic support member comprising a plurality of concentric sections that are extendable and retractable within each other, wherein the plurality of concentric sections comprises a distal section and a proximal section, wherein the proximal section comprises an outer surface, wherein adjacent concentric sections are coupled together via interlocking features; and a seat receptacle comprising a bottom surface and a top surface, wherein the bottom surface of the seat receptacle is coupled to the telescopic support member and the top surface of the seat receptacle is configured to operably engage a user in a seated position;

wherein the apparatus is configurable in a sit-mode and a storage-mode, wherein in the sit-mode the plurality of concentric sections are at least partially extended and respective longitudinal axis' of the telescopic support member and the seat receptacle are perpendicular to each other, wherein in the storage-mode the plurality of concentric sections of the telescopic support member are retracted within each other and the outer surface of the proximal section is disposed adjacent the bottom surface of the seat receptacle so that the respective longitudinal axes' of the telescopic support member and the seat receptacle are parallel to each other the bottom surface of the seat receptacle is both slidably and pivotally coupled to the proximal section of the plurality of concentric sections of the telescopic support member;

in the sit-mode the proximal section of the plurality of concentric sections of the telescopic support member is coupled to the seat receptacle at a longitudinal midpoint of the seat receptacle;

in the storage-mode the proximal section of the plurality of concentric sections is coupled to the seat recepatcle adjacent a lateral end panel of the seat receptacle; and changing between the sit-mode and the storage-mode comprises sliding and pivoting of the telescopic support member relative to the seat receptacle.

2. A portable seat apparatus comprising:

a telescopic support member comprising a plurality of concentric sections that are extendable and retractable within each other, wherein the plurality of concentric sections comprises a distal section and a proximal section, wherein the proximal section comprises an outer surface, wherein adjacent concentric sections are coupled together via interlocking features; and a seat receptacle comprising a bottom surface and a top surface, wherein the bottom surface of the seat receptacle is coupled to the telescopic support member and the top surface of the seat receptacle is configured to operably engage a user in a seated position;

wherein the apparatus is configurable in a sit-mode and a storage-mode, wherein in the sit-mode the plurality of concentric sections are at least partially extended and respective longitudinal axis' of the telescopic support member and the seat receptacle are perpendicular to each other, wherein in the storage-mode the plurality of concentric sections of the telescopic support member are retracted within each other and the outer surface of the proximal section is disposed adjacent the bottom surface of the seat receptacle so that the respective longitudinal axes' of the telescopic support member and the seat receptacle are parallel to each other;

the proximal section of the plurality of concentric sections of the telescopic support member comprises two elongate nubs extending from opposite sides of the outer surface and two respective circular nubs extending from the elongate nubs;

the bottom surface of the seat receptacle comprises two tapering channels, which taper from a wide portion to a narrow portion, and two respective uniform channels formed in the tapering channels;

the elongate nubs are slidably engaged in the respective tapering channels and the circular nubs are slidably engaged in the respective uniform channels;

when the elongate nubs are disposed in the wide portion of the respective tapering channels, the telescoping support member is pivotable relative to the seat receptacle; and when the elongate nubs are disposed in the narrow portion of the respective tapering channels, the telescoping support member is prevented from pivoting relative to the seat receptacle.

3. The apparatus of claim 1, wherein the interlocking features comprise one or more protrusions engageable within grooves, wherein each groove comprises a longitudinal-sliding portion and a bent-retaining portion.

4. The apparatus of claim 3, wherein the one or more protrusions are disposed on inner surfaces of one or more of the concentric sections and the grooves are disposed on outer surfaces of one or more of the concentric sections.

5. The apparatus of claim 3, wherein relative rotation between adjacent concentric sections of the plurality of concentric sections switches between a slide orientation and a locked orientation, wherein the slide orientation is when the one or more protrusions are engaged within the longitudinal-sliding portion of the grooves and the locked orientation is when the one or more protrusions are engaged within the bent-retaining portion of the grooves.

6. The apparatus of claim 5, wherein the telescopic support member comprises a visible locking indicator that indicates whether the plurality of concentric sections are in the slide orientation or the locked orientation.

7. The apparatus of claim 1, wherein the plurality of concentric sections extend in a first direction and retract in a second direction opposite the first direction, wherein the interlocking features limit extension of the plurality of concentric sections to the first direction and thus prevent extension of the plurality of concentric sections in the second direction.

8. The apparatus of claim 1, wherein the seat receptacle comprises lateral end panels that engage lateral edges of the concentric sections in the storage-mode.

9. The apparatus of claim 1, wherein the seat receptacle and the telescopic support member are cylindrical and have a circular cross-sectional shape.

10. The apparatus of claim 1, wherein the seat receptacle is a unitary component.

11. The apparatus of claim 1, wherein total height of the telescopic support member is adjustable via the interlocking features.

12. The apparatus of claim 1, wherein at least one of the plurality of concentric sections comprises interlocking features substantially along its entire length to provide adjustability to a height of the telescopic support member.

13. The apparatus of claim 1, wherein the distal section of the plurality of concentric sections of the telescopic support member comprises a swappable distal tip for engaging different types of terrain.

14. A portable seat apparatus comprising:

a telescopic support member comprising a plurality of concentric sections that are extendable and retractable within each other, wherein the plurality of concentric sections comprises a distal section and a proximal section, wherein the proximal section comprises an outer surface, wherein adjacent concentric sections are coupled together via interlocking features; and a seat receptacle comprising a bottom surface and a top surface, wherein the bottom surface of the seat receptacle is slidably and pivotally coupled to the proximal section of the plurality of concentric sections of the telescopic support member and the top surface of the seat receptacle is configured to operably engage a user in a seated position;

wherein:

the apparatus is configurable in a sit-mode and a storage-mode;

in the sit-mode the plurality of concentric sections are at least partially extended, respective longitudinal axis' of the telescopic support member and the seat receptacle are perpendicular to each other, and the proximal section of the plurality of concentric sections of the telescopic support member is coupled to the seat receptacle at a longitudinal midpoint of the seat receptacle;

in the storage-mode the plurality of concentric sections of the telescopic support member are retracted within each other, the outer surface of the proximal section is disposed adjacent the bottom surface of the seat receptacle so that the respective longitudinal axes' of the telescopic support member and the seat receptacle are parallel to each other, and the proximal section of the plurality of concentric sections is coupled to the seat receptacle adjacent a lateral end panel of the seat receptacle; and changing between the sit-mode and the storage-mode comprises sliding and pivoting of the telescopic support member relative to the seat receptacle.

* * * * *